US008317661B2

(12) United States Patent
Wight

(10) Patent No.: US 8,317,661 B2
(45) Date of Patent: Nov. 27, 2012

(54) METHODS AND SYSTEMS OF A POWER LADDER

(76) Inventor: Andrew S. Wight, Westbrook, ME (US)

( * ) Notice: Subject to any disclaimer, the term of this patent is extended or adjusted under 35 U.S.C. 154(b) by 32 days.

(21) Appl. No.: 12/984,842

(22) Filed: Jan. 5, 2011

(65) Prior Publication Data

US 2011/0166000 A1 Jul. 7, 2011

Related U.S. Application Data

(60) Provisional application No. 61/292,427, filed on Jan. 5, 2010.

(51) Int. Cl.
*A63B 21/00* (2006.01)

(52) U.S. Cl. ..... 482/38; 482/92; 482/96; 482/37

(58) Field of Classification Search ..... 182/152, 182/141, 128–130; 482/38, 92, 96, 15, 16, 482/33, 37, 41

See application file for complete search history.

(56) References Cited

U.S. PATENT DOCUMENTS

| | | | | |
|---|---|---|---|---|
| 1,881,902 | A * | 10/1932 | Osterdahl | 248/238 |
| 4,278,250 | A | 7/1981 | Baynes et al. | |
| 4,643,274 | A * | 2/1987 | Tataseo | 182/106 |
| 4,848,737 | A | 7/1989 | Ehrenfield et al. | |
| 5,112,043 | A | 5/1992 | Gilfillian, Jr. et al. | |
| 5,655,623 | A * | 8/1997 | Skyba | 182/116 |
| 6,688,797 | B2 * | 2/2004 | Park et al. | 403/93 |
| 6,767,314 | B2 | 7/2004 | Thompson et al. | |
| 7,699,756 | B2 * | 4/2010 | Piane, Jr. | 482/38 |

OTHER PUBLICATIONS

J Fit Adjustable Step Hurdles—10-3073 Fitness Equipment and More, p. 1; http://w\\rw.fitnessequipmentandmore.com/asp/show_detail.asp?sku:=FIT1030; Dec. 28, 2010.

High Step Runner—knee-high agility trainer for foot speed, quickness and sport specific; p. 1; http; //www,shapeupshop.com/agility/high_step_runner, htm; Dec. 28, 2010.

Agility Ladder, Exercise/Fitness—Allegro Medical Supplies; p. 1; http://www.allegromedical.com/exercise-fitness-c523/agility-ladder-pI90303.html7engin . . . ; Dec. 28, 2010.

* cited by examiner

*Primary Examiner* — Jerome W Donnelly

(74) *Attorney, Agent, or Firm* — GTC Law Group LLP & Affiliates

(57) ABSTRACT

A power ladder for exercising and fitness is disclosed. Embodiments of the power ladder are lightweight and compact, and fold for easy storage and transport. Embodiments include two flexible plastic side rails and a plurality of rungs connected to the side rails at intervals along the side rails. The rungs connect pivotally and slidably to the rails. The rungs are mounted on telescoping legs so that the rungs may be used in a first position adjacent the ground, in a second position above the ground, and in some embodiments, a third position, mounted higher above the ground than the second position. Using the ladder, persons can train for agility, flexibility and plyometrics, and can thus achieve excellent exercising while having fun. One or more persons or even a team may use the ladder. Larger teams may compete using one ladder or more than one of the ladders.

20 Claims, 5 Drawing Sheets

METHODS AND SYSTEMS OF A POWER LADDER

PRIORITY CLAIM

The present application claims priority to, and the benefit of, U.S. Provisional Appl. No. 61/292,427, Methods and Systems of a Power Ladder, filed on Jan. 5, 2010, under the provisions of 35 U.S.C. §119, the contents of which are hereby incorporated by reference in their entirety.

FIELD

The field of the present disclosure is that of exercise devices, and in particular exercises which are used for both speed and agility training and also strength training, with an emphasis on plyometrics.

BACKGROUND

Regular physical activity, fitness and exercise are important in leading a healthy lifestyle and preventing disease. A recent report from the Department of Health and Human Services (HHS), Office of the Assistant Secretary for Planning Evaluation, details many of the benefits of an active lifestyle, while also listing many of the consequences of leading a sedentary lifestyle. The report is entitled, "Physical Activity Fundamental to Preventing Disease," and was published on Jun. 20, 2002. This report includes many facts and figures on the health costs of an inactive lifestyle, especially when combined with consequences of an unhealthy diet.

As stated in the report, regular physical activity has been shown to reduce morbidity and mortality from many diseases, especially chronic diseases. Such diseases can be prevented or improved through regular physical activity. For example, 14 percent of all deaths in the United States have been attributed to activity patterns and diet, according to the Journal of the American Medical Assn. (JAMA), *Actual Causes of Death in the United States,* 270(18):2207-12 (1993), J. M. McGinnis and W. H. Foege. As also stated in the HHS report, 12.6 million Americans have coronary heart disease and 1.1 million people suffer from a heart attack in a given year. About 17 million Americans have diabetes, of which 90-95% is type 2 diabetes, which is associated with obesity and physical activity. Perhaps even more alarming, approximately 16 million people have pre-diabetes. It is estimated that about 50 million people have high blood pressure, according to the American Heart Association, 2002 Heart and Stroke Statistical Update.

The HHS report also notes that most adults and many children lead a relatively sedentary lifestyle and are not active enough to achieve the benefits known to accrue to those who are physically active. On a more positive note, persons with a healthier lifestyle live an average of 6 to 9 years longer. JAMA 1999; 282:2012-2018, *Low risk-factor profile and long-term cardiovascular and noncardiovascular mortality and life expectancy* (findings for 5 large cohorts of young adult and middle-aged men and women), J. Stamler, R. Stamler and J. D. Neaton. These people also tend to postpose disability by 9 years, and tend to compress any disability into fewer years at the end of their life. N. Engl. J. Med. 1998; 338:1035-1041, *Aging, health risks, and cumulative disability*, A. J. Vita, R. B. Terry, H. B. Hubert, J. F. Fries.

As reported elsewhere, up to 55% of Americans do not get enough physical exercise, while about two-thirds of Americans are overweight or obese. Centers for Disease Control and Prevention, *Prevalence of Physical Activity, Including Lifestyle Activities Among Adults—United States,* 2000-2001, MMWR 2003; 52(32):764-769, available on line at http://www.cdc.gov/mmwr/preview/mmwrhtml/mm5232a2.htm; JAMA 2002; 288:1723-1727, *Prevalence and Trends in Obesity Among US Adults*, 1999-2000, K. M. Flegal, M. D. Carroll, C. L. Ogden, C. L. Johnson.

It seems clear, then, that more Americans should be exercising regularly and also should participate generally in more healthy lifestyles and with better nutritional practices. One way to encourage regular exercise is to make exercising fun. It would also be beneficial if any equipment used for exercising is both useful and inexpensive. One way to exercise involves equipment generally known as exercise ladders. Exercise ladders generally resemble ladders used for climbing, in the sense that both have long side rails joined by rungs or cross pieces at intervals along the side rails. Exercise ladders are typically made from very thin or flexible materials and are not capable of supporting body weight. Exercise ladders are typically laid on the ground.

A person uses an exercise ladder by running or jumping between the rungs to increase both speed and agility. With several ladders laid adjacent one another, teams or sports clubs can run agility drills while introducing an element of competition at the same time. For example, squads or teams can compete in completing a certain exercise or agility drill, with the first team to complete the drill winning the competition. The drills may include such routines as each player running through the ladder one way or both ways; the routines may vary the number of rungs completed or skipped, and so forth.

These exercises can be very physically demanding. However, after several exercises, it would be good if there were a variation of the ladder routine available to the competitors. Such variations would help keep the exercise and the competition fresh for the participants. Any such variations should fit easily into an exercise ladder and should be relatively inexpensive in order to keep help keep this equipment within a reasonable price range for all consumers.

SUMMARY

One embodiment is an exercise ladder for use atop a playing surface. The exercise or power ladder induces two side rails, a plurality of rungs connecting the two side rails at intervals along the side rails, a plurality of legs between the plurality of rungs and the side rails, and a plurality of pivot hinges connecting the plurality of rungs to the plurality of legs, wherein each rung of the plurality of rungs is connected independently to the side rails, and each leg has a first lower position and at least one raised position above the ground.

Another embodiment is an exercise ladder for use on a playing surface. The exercise ladder includes two side rails, a plurality of rungs connecting the two side rails at intervals along the side rails, a plurality of telescoping legs between the plurality of rungs and the side rails, and a plurality of pivot hinges connecting the plurality of rungs to the plurality of telescoping legs, wherein each rung of the plurality of rungs is connected independently to the telescoping legs, and wherein each telescoping leg has a first flat position adjacent the ground and at least one raised position above the ground.

Another embodiment is an exercise ladder for use on a playing surface. The exercise ladder includes two side rails, a plurality of rungs connected to the two side rails at intervals along the side rails, a plurality of telescoping legs, a plurality of pivot hinges connecting the plurality of telescoping legs to the rungs, and a plurality of spring hinges connecting the plurality of telescoping legs to the side rails, wherein each rung of the plurality of rungs is connected independently to the side rails, and each rung has a first flat position adjacent the playing surface and at least one raised position above the ground.

This disclosure includes a number of embodiments, and is intended to be descriptive of any number of embodiments, rather than limiting.

DETAILED DESCRIPTION

Figure 1:
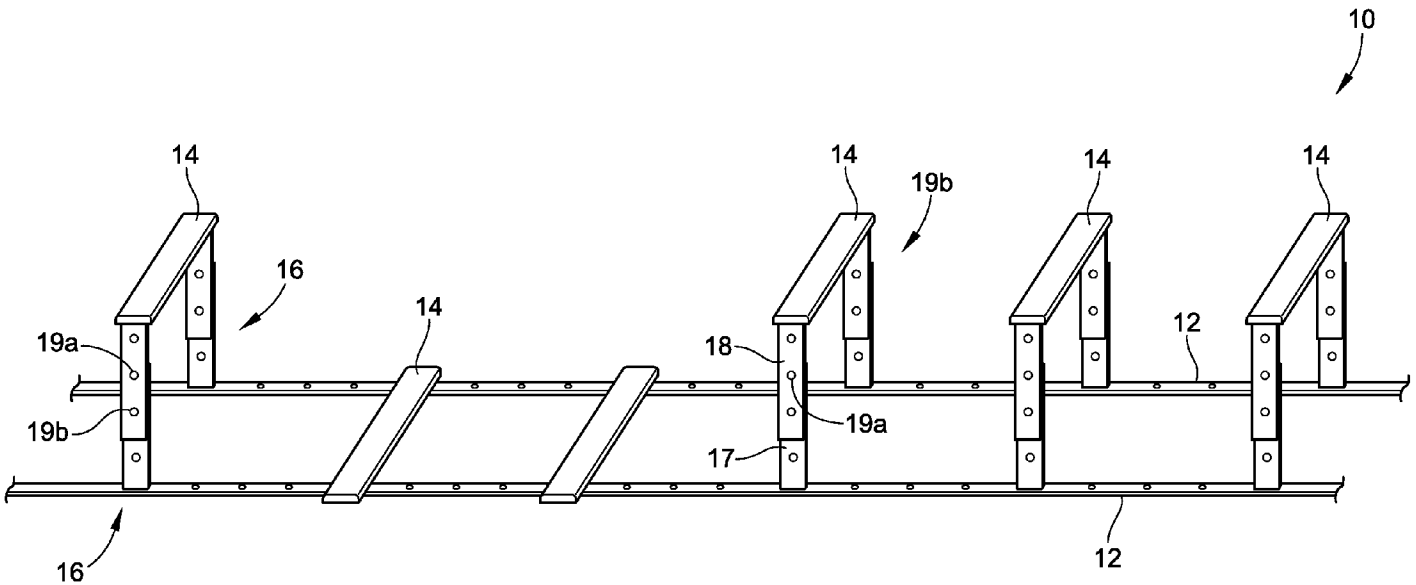
FIG. 1 depicts an isometric view of a first embodiment.

FIG. 1 depicts a Power Ladder set up for use by a person. Power ladder 10 includes two side rails 12 and a plurality of rungs 14. Each rung 14 includes a leg 16 on each side for connection to a side rail 12. In this embodiment, each leg 16 includes a lower leg 17 connected to the side rail 12 and an upper leg 18 which is connected to a rung 14. The upper leg 18 may contain detents 19*a* for placement in orifices 19*b* of the lower leg 17. The detents reside within upper leg 18 and may have spring loaded portions which fit into the orifices 19*b*. Thus, each rung 14 may be positioned independently and may be in a flat position or in a raised position. In addition, the legs may be designed so there is more than one raised position. For example, in one embodiment, the legs may be raised to a first height of about 6 inches above the ground or side rails 12, and to a second height of about 9 inches above the ground. Other embodiments may have only a single raised position. Yet other embodiments may have three raised positions. The flat position may be adjacent the ground. For example, in one embodiment, the rung may have a hollow portion adjacent the ground, the hollow portion includes a space sufficient to accommodate the height of the rail adjacent the rung. Thus, in this embodiment, when the rung is in a lowered position, the bottom surface of the rung touches the ground and the portion of the side rail adjacent the rung is captured by the rung.

The up or down position of each rung may be adjusted by the person using the power ladder. The power ladder helps people to gain speed and agility as they run drills through the spaces between the rungs. The power ladder also helps people with plyometrics, that is, with strength training With the rungs all set in a down position, a person can optimize foot speed and agility training by being able to change speed and direction as quickly as possible without worrying about stepping sufficiently high to avoid raised rungs, i.e., hurdles. There are also proprioceptive and kinesthetic aspects to power ladder training as one's mechanoreceptors adjust the body's awareness in space. As more rungs are raised, more of the exercises are directed toward plyometrics and generating power. However, proprioception is still highly required and developed further because a person has to perceive and jump over the hurdle and land before taking the next step.

Figure 2:
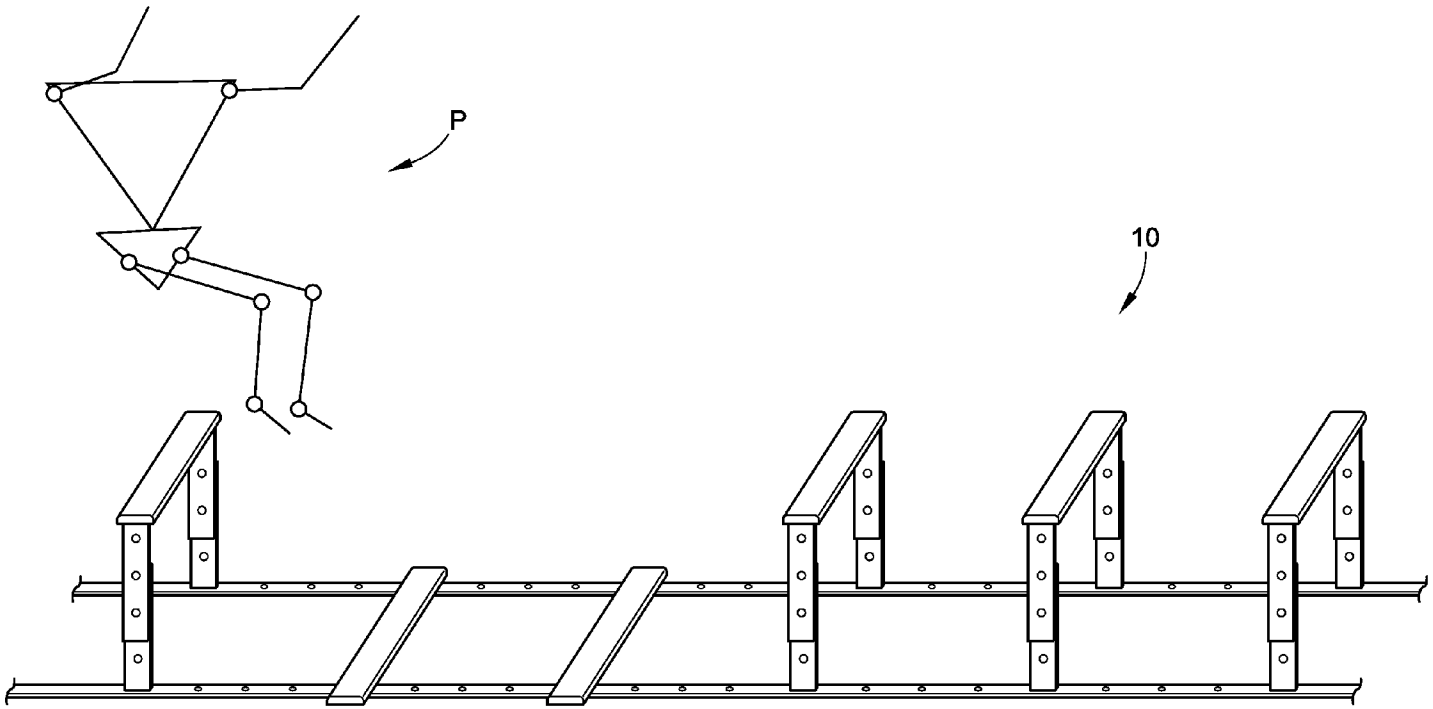
FIG. 2 depicts a person using a first configuration of the embodiment of FIG. 1.

As one steps through the exercise ladder or power ladder, more muscles and more muscle power are needed to step through the spaces between the raised rungs or hurdles. Muscules then tend to develop in order to generate the force needed to move the body over the hurdle and then step again as the foot comes back in contact with the ground. FIG. 2 shows a person P using power ladder 10. The person is performing a two legged hop over a hurdle then transitioning into two successive agility footwork movements followed by more repetitive plyometric movements.

As the person varies the position of the rungs, some raised and some lowered, a different rhythm is required for the exercise. A maximum of awareness and agility may be required when every second rung is raised, with the remainder being in a lowered position. A different level of awareness and proprioception is required when all rungs are raised, and the person must step high between each rung to complete the agility drill. Alternatively, the person could require jumping from one space to the next as the person goes through the drill. In short, the variations of exercises possible are virtually unlimited with this exercise or power ladder.

Also contributing to the utility of embodiments of the power ladder is the ease with which each rung is raised or lowered, as explained with reference to FIGS. 3A-3E and 4A-4C. In one embodiment, each rung 20 is supported on each side by a telescoping leg. As shown in FIGS. 4A-4C, the telescoping legs may have three positions, e.g., stowed within the rung, extended partially, or extended fully. As shown in FIGS. 3A-3E, in one embodiment, legs may include a pivot hinge, upper and lower leg portions, and a spring hinge connecting the lower leg portion to the side rail on that side of the power or exercise ladder. The pivot hinge connects the upper leg portion to the rung.

Figure 3A:
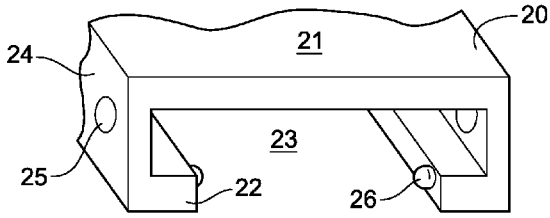
FIGS. 3A-3E depict component parts of an embodiment of a power ladder.
Figure 4A:
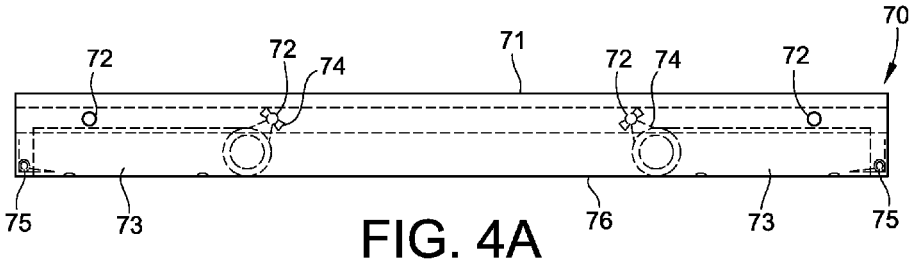
FIGS. 4A-4D depict different positions of the embodiments of FIGS. 3A-3E.
Figure 4B:
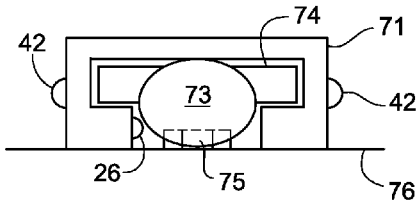
Figure 4C:
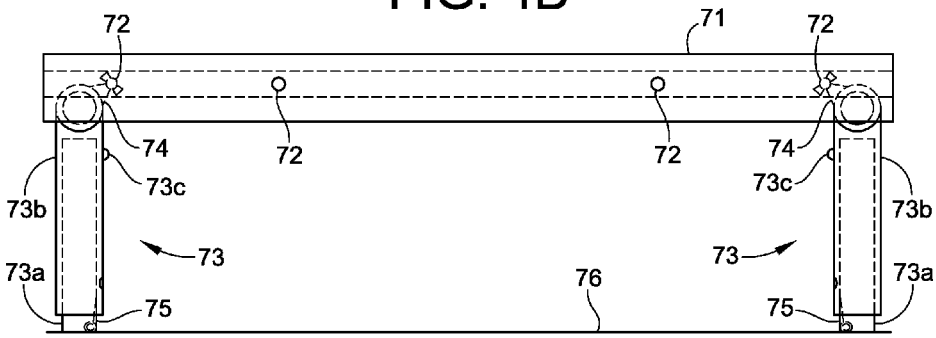

FIG. 3A depicts a rung 20 used in embodiments of the power or exercise ladder. Rung 20 is made from wood, plastic, or other suitable material. The rung is sufficiently long to reach from a rail on one side of the ladder to the rail on the opposite side, as shown in FIGS. 1-2. The rung includes a top surface 21, a bottom surface 22, a hollow central portion 23 and sides 24. The hollow central portion 23 has a cross-section generally in a shape of a T, with a wider top portion and a narrower bottom portion. Sides 24 include orifices 25 for accommodating detents or other holders for legs supporting the rungs, the legs and rungs forming hurdles when in a raised position. Each side of the rung 20 also includes a stop 26 for retaining a pivot hinge within the hollow space, as discussed below. Each side may have one stop 26, as shown, or may have a second stop opposite the first stop for more positive retention. In this embodiment, stop 26 has a hemispherical shape. Other embodiments may have other shapes.

Figure 3B:
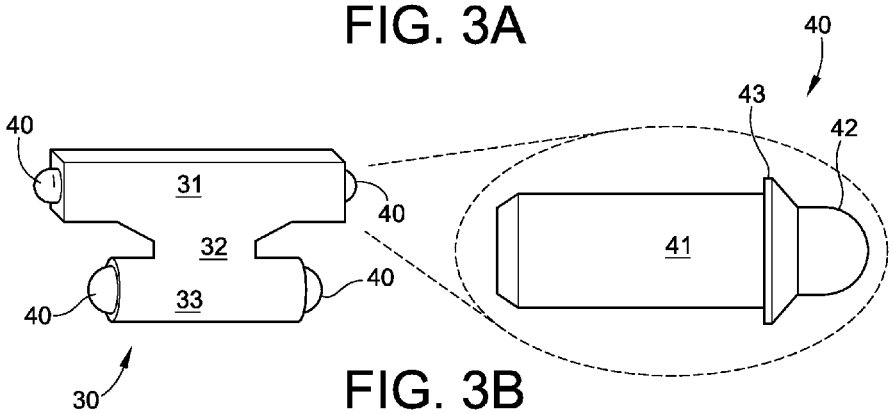

A pivot hinge 30, as shown in FIG. 3B, connects rung 20 to the legs supporting the rungs. Pivot hinge 30 may be made of a suitable plastic or metal, or other material as desired. The pivot hinge includes an upper portion 31 with a first set of detents 40. The detents 40 have hollow bodies 41 and may have spring loaded plungers 42. The detent may also include a flange 43 for retention in place. When one presses on the plunger 42, the plunger retracts, allowing for one to move the pivot hinge 30 and detents 40 within the hollow 23 of the rung. When the pivot hinge is aligned with the orifices 25, the detents will pop out and the plungers 42 will retain the pivot hinge in place. Because the orifices 25 and plungers 42 have radial symmetry, the pivot hinge may rotate or at least pivot, allowing the pivot hinge to enter the hollow space. As shown below in FIG. 4A, the pivot hinge has at least one additional position within the rung. Thus, the pivot hinge will pivot further when the user pushes the pivot hinge, disengaging the detents, and causing the pivot hinge and the legs into a storage position with the rung. Of course, the width of upper portion 31 is less than the distance across the width of the hollow 23 of rung 20, so that upper portion 31 will fit into the upper part of the hollow and may be slid inwardly and outwardly in the hollow. This movement allows a user to stow the legs and to pull out and extend the legs for use in exercises.

Pivot hinge 30 also has a lower portion 33 with a second set of detents 40. The second set of detents may be the same as the first set or may be different. For example, they may have a shorter body length than the first set. There is also a narrow transition portion 32 between the upper 31 and lower 33 portion of pivot hinge 30. Upper portion 31 is depicted as having a hollow square cross-section. Other embodiments may have a hollow cylindrical cross section, or other cross section of a suitable shape.

Figure 3C:
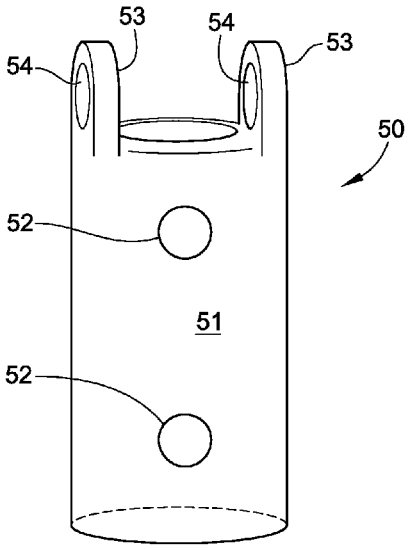

The second set of detents 40 in lower portion 33 fit into orifices 54 in ears 53 of upper leg portion 50, as shown in FIG. 3C. Upper leg portion 50 includes a hollow, generally cylindrically-shaped body 51, with orifices 52. In this embodiment, the body orifices 52 are oriented at about 90 degrees from the ears 53 and the ear orifices 54. In this embodiment, ears 53 are oriented with the long axis of the power ladder, with the orifices 52 oriented along the axis for the rungs. Upper leg portion 50 is held by the second set of detents 40 in the orifices 54 of ears 53.

Figure 3D:
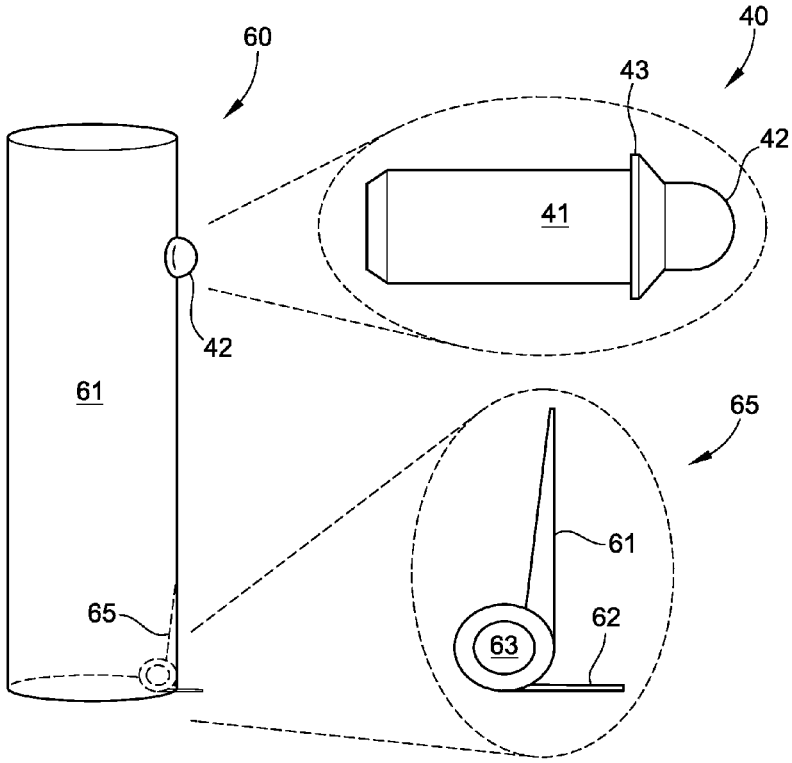

As shown in FIGS. 3C and 3D, upper leg portion 50 has a larger diameter than lower leg portion 60, which may be contained within upper leg portion 50. Lower leg portion 60 also has a hollow, generally cylindrically-shaped body 61 and includes a single detent 40. Detent 40 may be the same as the detents previously shown or may be different. For example, the detent may have a longer or short body length 41. Detent plunger 42 fits within upper orifice 52 when the leg is stowed or in a partially-extended position, as shown in FIGS. 4A and 4B. Detent plunger 42 fits within lower orifice 52 when the legs are in a fully extended position, as shown in FIG. 4C.

Figure 3E:
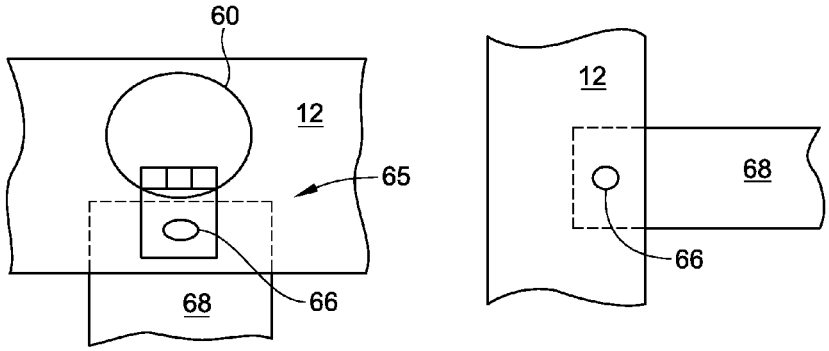

Lower leg portion 60 may also be equipped with a spring hinge 65. Spring hinges of many types are available, for example, from H.A. Guden Co., Ronkonkoma, N.Y., USA. Spring hinge 65 includes a first and second legs 61 and 62, and hinged central spring 63. Legs 61 and 62 are aligned with detent 42. Spring hinge 65 acts as a connector to connect lower leg portion 60 to a side rail 12. The spring hinge 65 helps to space and orient the leg with the side rail 12. The spring hinge urges the leg, include lower leg portion 60, away from the side rail and into an upright position. Two top views are also shown in FIG. 3E. In the left view, side rail 12 is shown in a left-to-right orientation, with lower leg portion 60. Lower leg portion 60 is attached to side rail 12 with spring hinge 65 using rivet 66. Spring hinge 65 is also attached to lower leg portion 60 with a rivet (not shown). In other embodiments, the spring hinge may be attached by gluing, with fasteners, or if the parts are metal, by welding or brazing. In addition, an extra length of plastic 68 is shown underneath side rail 12, which may also be attached to the side rail using the same rivet 66. This length of plastic is added to lend a little additional stiffness and stability to the exercise or power ladder. Plastic length 68 may be about 1 or 2 inches wide and may be from about 0.030 inches thick to about 0.060 inches thick. Other thicknesses and widths may be used as desired.

FIGS. 4A-4D depict a top or bottom elevation view of the exercise or power ladder. In these views, a one-rung portion 70 of the ladder is sequentially depicted in a stowed position, FIG. 4A, in a partially raised position FIG. 4C, and in a fully extended or raised position, FIG. 4D. FIG. 4B depicts a side elevation view of this portion of the ladder.

In FIG. 4A, rung 71 is adjacent a playing surface, such as the ground. Rung 71 includes four orifices 72 for accommodating a plunger from a detent, as discussed. As seen in this figures, the detents from pivot hinges 74 are engaged in the inner orifices 72. A leg 73 from a left side and a leg 73 from a right side is depicted stored within the hollow space of rung 71. Each leg 73 along includes a pivot hinge 74. As discussed, the pivot hinge is mounted slidably within the rung, or within the hollow portion of the rung, because the upper portion of the hollow of the rung is slightly wider than the upper portion of the pivot hinge. Spring hinges 75 are closed, with the legs facing the same direction (inwardly) and the spring at maximum compression. In this view, the additional piece of plastic 76 is depicted under the rung.

FIG. 4B depicts a side view of ladder portion 70, with the legs still in the stowed position, as depicted in FIG. 4A. In this side view, legs 73 are seen to fit within the hollow space of rung 71, and spring hinge 75 is visible from the side. Side stop 26, as discussed above, helps retain the leg 73 in place within the hollow. Detent plungers 42 are visible, the plungers from each side of pivot hinges 74, similar to pivot hinges 30 in earlier figures. Note that the cross section of pivot hinges 74 is a little smaller than the hollowed-out portion on the inside of rung 71. Leg 73 is also seen to be very close to the ground, adjacent the ground, and separated from the ground only by plastic 76 and spring hinge 75, which forms a part of leg 73.

In FIG. 4C, the legs 73 are extended partially. Rung 71 is raised to about a 6 inch height, and the legs 73 have now left their stowed positions in rung 71 and are now deployed perpendicularly to rung 71. Each leg 73 is now seen to include a lower portion 73*a* and an upper portion 73*b*. FIG. 4B also shows detent 73*c* from the lower leg 73*a* extending through the upper orifice of upper leg 73*b*. Pivot hinges 74 are engaged through their detents with the outer orifices of the rung. Spring hinges 75 are now open, with one leg at a right angle to the other leg. Rung 71 now is in position as a low hurdle for exercise purposes.

Figure 4D:
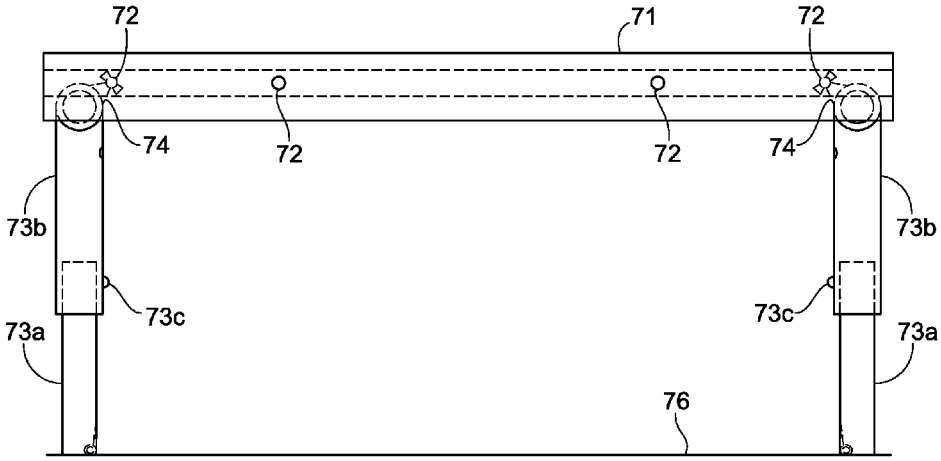

The rungs of the ladder may also be raised to a higher position, as shown in FIG. 4D. The difference from FIG. 4C is that the lower legs 73*a* are now fully extended, and the detents 73*c* now engage the lower orifice of upper legs 73*b*. The positions of the pivot hinges 74 relative to the rungs have not changed, and the spring hinges 75 continue to help orient legs 73 at an upright, ninety degree orientation from the side rails (not shown in FIGS. 4A-4C). In this position, rung 71 acts as a higher hurdle for exercise purposes, and as noted above, for plyometrics training.

Various exercises may help train the body for coordination, proprioception, kinesthesia, and muscular education. Movements done assist with being able to control the bodies center of gravity moving in one direction and quickly firing muscles to decelerate and change to another direction. This can be executed with this ladder. Raising the rungs of the ladder alter the movements by adding in plyometric training Plyometric training is training for an ability of muscles to generate bursts of power. With this design, by raising a rung, individual hurdles may be set up. Therefore exercises and workouts become more efficient and you can utilize less amounts of space. Also the hurdles set within this ladder are adjustable from 6 inches to 9 inches, which requires less equipment. Of course, other embodiments may use higher or lower heights, depending on the person and on the training desired.

This type of training may be beneficial to most every person (limiting factor are those with previous injuries or certain musculoskeletal aliments). Coordination may be a factor of re-educating the motor units within a body. As motor units begin to fire, more muscles are recruited leading to an improvement in performance and also decrease potential for injury. Also proprioception is increase in individuals creating a better awareness in space for the body. This can also lead to better performance and decrease in potential for injury.

While this disclosure has included several embodiments shown and described in detail, various modifications and improvements thereon will become readily apparent to those skilled in the art. Accordingly, the spirit and scope of the claims is not to be limited by the foregoing examples, but is to be understood in the broadest sense allowable by law.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

While embodiments have been disclosed and described in detail, it is understood that various modifications and improvements thereon will become readily apparent to those skilled in the art. Accordingly, the spirit and scope of the present disclosure is not limited by the foregoing examples, but is better understood by the claims below.

What is claimed is:

1. An exercise ladder for use atop a playing surface, comprising:

two side rails;

a first rung;

a first pair of pivot hinges connected to the first rung;

a first pair of legs between the first pair of pivot hinges and the side rails for connecting the first rung to the side rails;

a second rung spaced apart from the first rung;

a second pair of pivot hinges connected to the second rung; and a second pair of legs between the second pair of pivot hinges and the side rails for connecting the second rung to the side rails;

wherein each of the first and second rungs is connected independently to the side rails and each leg of the first and second pairs of legs has a first lower position and at least one raised position above the playing surface.

2. The exercise ladder according to claim 1, further comprising two connectors per leg for connecting each leg to the side rails.

3. The exercise ladder according to claim 2, wherein each of the connectors comprises a spring hinge for connecting a leg to one of the side rails.

4. The exercise ladder according to claim 1, wherein each pivot hinge comprises two detents for connecting to one of the legs.

5. The exercise ladder according to claim 1, wherein each of the legs comprises a telescoping leg, and wherein a position of each of the telescoping legs is set with a detent.

6. The exercise ladder according to claim 1, wherein each of the plurality of legs comprises an upper portion, a lower portion and at least one spring detent connecting the upper and lower portions.

7. The exercise ladder according to claim 1, further comprising spring hinges connecting each of the plurality of rungs to the side rails.

8. The exercise ladder according to claim 1, wherein each of the plurality of legs is capable of placement with one of the rungs.

9. The exercise ladder according to claim 1, wherein a portion of the side rails fits within each of the rungs.

10. An exercise ladder for use on a playing surface, comprising:

two side rails;

a plurality of rungs for connecting the two side rails at invervals along the side rails;

a plurality of telescoping legs between the plurality of rungs and the side rails; and a plurality of pivot hinges connecting the plurality of rungs to the plurality of telescoping legs, wherein each rung of the plurality of rungs is connected independently to the telescoping legs, and wherein each telescoping leg has a first flat position adjacent the ground and at least one raised position above the ground.

11. The exercise ladder according to claim 10, further comprising a plurality of spring hinges connecting the plurality of telescoping legs to the side rails.

12. The exercise ladder according to claim 10, wherein each of the telescoping legs comprises an upper portion and a lower portion, the upper and lower portions connected by a detent.

13. The exercise ladder according to claim 10, each of the plurality of rungs further comprises a T-shaped hollow within the rung.

14. The exercise ladder according to claim 10, wherein a portion of the side rails fits within a hollow portion of each of the rungs.

15. An exercise ladder for use on a playing surface, comprising:

two side rails;

a plurality of rungs for connecting to the two side rails at invervals along the side rails;

a plurality of telescoping legs;

a plurality of pivot hinges connecting the plurality of telescoping legs to the rungs; and a plurality of spring hinges connecting the plurality of telescoping legs to the side rails, wherein each rung of the plurality of rungs is connected independently to the side rails, and each rung has a first flat position adjacent the playing surface and at least one raised position above the ground.

16. The exercise ladder according to claim 15, wherein the side rails comprise flexible plastic.

17. The exercise ladder according to claim 15, wherein the telescoping legs have two positions.

18. The exercise ladder according to claim 15, wherein the playing surface is ground.

19. The exercise ladder according to claim 15, wherein each rung further comprises a hollow space for accommodating two of the telescoping legs and two of the pivot hinges.

20. The exercise ladder according to claim 15, wherein each of the pivot hinges further comprises detents.

* * * * *